United States Patent [19]

Yoshino et al.

[11] 4,443,093

[45] Apr. 17, 1984

[54] ELECTROSTATIC PRINTING METHOD

[75] Inventors: Masaki Yoshino; Kozo Oka; Huminori Koide, all of Kanagawa, Japan

[73] Assignee: Fuji Xerox Co., Ltd., Tokyo, Japan

[21] Appl. No.: 415,622

[22] Filed: Sep. 7, 1982

[30] Foreign Application Priority Data

Sep. 7, 1981 [JP] Japan ..... 56-139816

[51] Int. Cl.[3] ..... G03G 15/00

[52] U.S. Cl. ..... 355/3 CH; 355/77; 430/31; 430/902; 101/DIG. 13

[58] Field of Search ..... 355/3 CH, 3 R, 77, 14 CH; 430/31, 902; 101/DIG. 13

[56] References Cited

U.S. PATENT DOCUMENTS

| | | | |
|---|---|---|---|
| 3,615,128 | 10/1971 | Bhagat | 355/3 R |
| 3,795,442 | 3/1974 | Kimura et al. | 355/3 R |
| 4,273,438 | 6/1981 | Nishikawa | 101/DIG. 13 |

*Primary Examiner*—R. L. Moses

*Attorney, Agent, or Firm*—Sughrue, Mion, Zinn, Macpeak & Seas

[57] ABSTRACT

In an electrostatic printing method of the type wherein a toner image is fixed on a printing master, the master is repeatedly run through a charging operation with a discharging lamp or the like maintained off, until the potential thereof reaches a value approximating a practical printing value. The lamp is then turned on and the master again repeatedly charged until the practical value is reached, prior to using the master for printing.

8 Claims, 3 Drawing Figures

ELECTROSTATIC PRINTING METHOD

BACKGROUND OF THE INVENTION

Printing according to an electronic photographic system is well known in the art. For instance, a zero printing system disclosed by U.S. Pat. No. 2,576,047 and an electronic printing apparatus disclosed by Japanese patent application Publication No. 1554/1968 are well known in the art. In this prior art, a toner image is formed on a photo-conductive plate according to an electrostatic photographic method and is fixed, so that a non-photo-sensitive insulating pattern, namely, a printing master, is formed on the photo-conductive plate. In succession, the printing master is uniformly charged and is uniformly exposed to light, whereby the charges are held only on the image region which is not photo-sensitive, while the charges are removed from the photo-sensitive region. Therefore, by applying charged toner to the partially charged plate, a toner image is formed thereon. The toner image is then transferred onto a suitable image support. The above-described operation is repeatedly carried out to obtain prints.

More specifically, the aforementioned Japanese patent Application No. 1554/1968 discloses an apparatus as shown in FIG. 1. In FIG. 1, reference numeral 1 designates a rotary drum which has pawls on the cylindrical wall thereof, to hold a photo-sensitive sheet 10. Provided around the drum 1 are a cleaning unit 8, a charging unit 4, a uniform exposure lamp 13, a developing unit 5, a transferring corotron 6 and an infrared fixing unit 7 for fixing a toner image on the photo-sensitive sheet 10.

The printing master is formed as follows: A photo-sensitive sheet 10, after being wound on the drum 1, is charged by the charging unit 4. The image of an original on a platen 3 which is illuminated by an illuminating lamp 14 is projected onto the photo-sensitive sheet 10 by a projecting lens 2, so that an electrostatic latent image is formed therein. The latent image is visualized by the developing unit 5, and the toner image is fixed on the photo-sensitive sheet 10 through fusion by the infrared fixing unit 7, to thus form the printing master.

The method of obtaining a number of copies from the printing master thus formed by electrostatic printing proceeds as follows: The printing master having the toner image on the photo-sensitive sheet is charged by the charging unit 4 and is then uniformly exposed to light by the uniform exposure lamp 13. The charges on the photo-sensitive sheet 10 charged uniformly are selectively caused to flow off by uniform exposure with the exception of those on the toner image region which is not photo-sensitive and not photo-conductive. Thus,a printing master having charges on only the toner image region is formed. The printing master thus formed is subjected to visualization by the developing unit 5. A transferring sheet 11 is delivered to the transferring section in synchronization with the rotation of the drum 1. The toner image on the printing master is transferred onto the transferring sheet by the transferring corotron 6 and then the image thus transferred is fixed by the fixing unit. Thereafter, the sheet is discharged into a sheet discharge tray, to thus form a copy of the printing master. The toner remaining on the printing master after printing is removed by the cleaning unit 8, to complete one printing cycle. Then, the printing cycle as described above is repeatedly carried out at many times as the required number of copies.

In the above-described method, an infrared fixing unit 7 is used to fix the toner image on the photo-sensitive sheet 10 in the course of forming the printing master. The present inventors have compared this method with other fixing methods by measuring potentials at image regions on the printing masters thereof. The comparative results are as indicated in Table 1 below:

TABLE 1

| Type of fixing unit | Potential at image region |
|---|---|
| Infrared fixing unit | −50 V |
| Flash fixing unit | −100 V |
| Hot roll fixing unit | −540 V |
| Pressure roll fixing unit | −500 V |

As is apparent from Table 1, the decrease in the potential at the image region when fixing is carried out with the infrared fixing unit or the flash fixing unit is larger than that of the potential at the image region when fixing is carried out with the hot roll fixing unit or the pressure roll fixing unit. Thus, the hot roll fixing method or the pressure roll fixing method may be employed as a fixing method in the formation of a printing master, and can maintain a sufficiently high potential at the image region. However, in either the hot roll fixing method or the pressure roll fixing method, the following operation must be carried out: After being peeled from the drum 1, the photo-sensitive sheet on which the toner image has been formed is delivered through a guide to the fixing unit, to be subjected to fixing. The photo-sensitive sheet thus treated is then delivered back to the drum 1, so that it is again supported on the drum. That is, the hot roll fixing method and the pressure roll fixing method are not preferable in that they require intricate, expensive auxiliary techniques.

SUMMARY OF THE INVENTION

Accordingly, an object of the invention is to provide an electrostatic printing method in which the potential at an image region can be gained sufficiently high even when an infrared fixing unit or flash fixing unit is used for fixing a toner image on a photo-sensitive sheet.

In the invention, the toner image which has been formed on a photo-sensitive sheet according to the electrostatic photographic method is fixed using the infrared fixing unit or the flash fixing unit, and then before a printing step is carried out, the printing master is repeatedly charged to recover the chargeability of the photo-conductive layer which is immediately below the image region of the printing master.

DETAILED DESCRIPTION OF THE PREFERRED EMBODIMENTS

Figure 1:
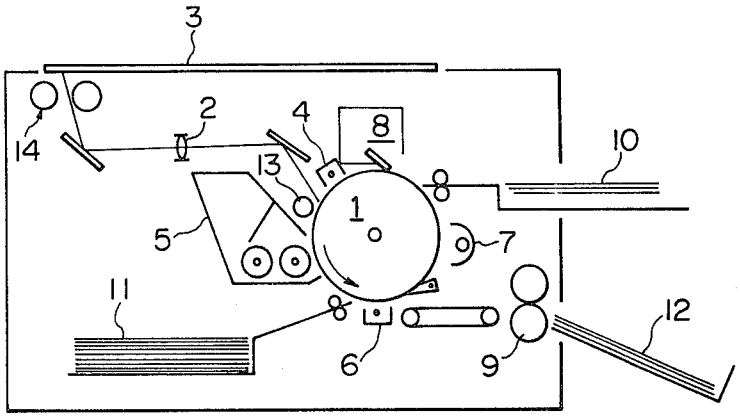
FIG. 1 is a sectional view outlining an electronic printing apparatus.

This invention will now be described with reference to FIG. 1.

The photo-conductive sheet 10 is wound on the drum 1 and is then charged by the charging unit 4. The image of the original is formed on the sheet by the projecting lens 2, so that an electrostatic latent image is formed in the photo-conductive sheet 10. Then, the latent image is made visual by the developing unit, and the toner image on the photo-conductive sheet is fixed by the infrared fixing unit 7. In this condition, the potential at the image region is too low to carry out the following printing operation.

In order to recover the chargeability of the toner image region, the inventors have proposed a method described in U.S. patent application Ser. No. 413,098, filed Aug. 30, 1982, in which the photo-conductive sheet is repeatedly charged by the charging unit 4. This invention is intended to improve the principle thus proposed, to thereby obtain a desired image region potential. The electrostatic printing method according to the invention will now be described in detail.

Figure 2:
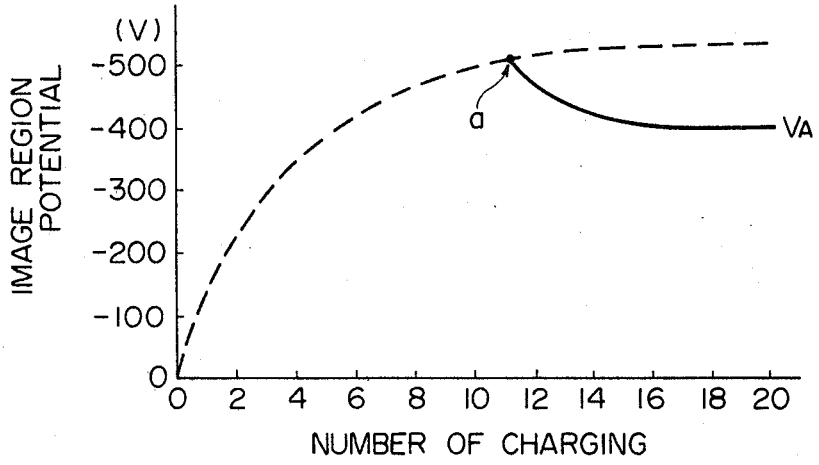
FIGS. 2 and 3 are graphical representations for describing the printing master chargeability recovering characteristic according to this invention.
Figure 3:
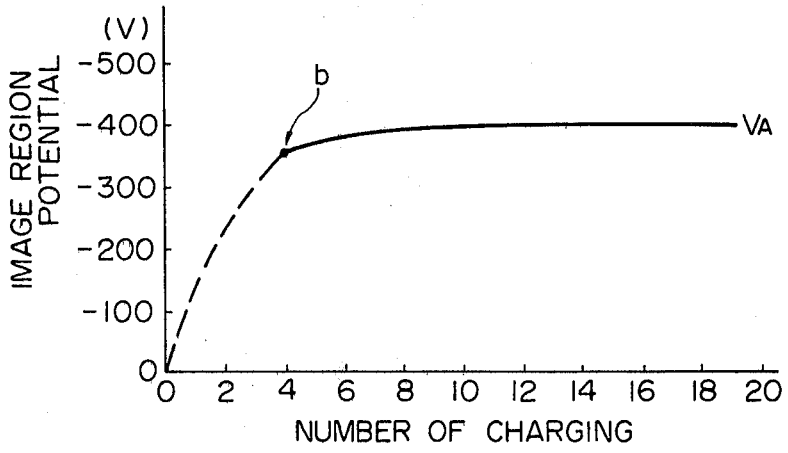

When a photo-conductive sheet having a toner image is repeatedly charged under the conditions that the uniform exposure lamp 3 or a discharging lamp (not shown) is maintained off, the image region potential is increased as indicated by the broken line in FIG. 2. When the uniform exposure lamp or the discharging lamp is turned on at a time instant a (FIG. 2) when the image region potential is substantially saturated, the image region potential immediately after the charging unit 4 is decreased to a second saturation potential. That is, it has been found that the saturation potential of the image region in the case where the uniform exposure lamp or the discharging lamp is turned on is different from that when the lamp is turned off. Therefore, the saturation potential when the uniform exposure lamp 13 or the discharging lamp is turned on may be employed as a final, stable, practical potential ($V_A$). The practical potential can be obtained quickly by the following method: The uniform exposure lamp or the discharging lamp is maintained turned off until a time instant immediately before or after the practical potential (−400 V in this case) is reached, and the uniform exposure lamp or the discharging lamp is then turned on at this time instant, as indicated in FIG. 3.

Accordingly, in the invention, a toner image is formed on a photo-conductive sheet according to the electrostatic photographic method and is fixed through fusion by a flash fixing unit or an infrared fixing unit to form a printing master. The printing master thus formed is repeatedly charged with the uniform exposure lamp or the discharging lamp maintained turned off. When the potential reaches a value from 0.7 to 1.3 times the aforementioned practical potential $V_A$, the discharging lamp is turned on and the charging operation is again repeatedly carried out. By carrying out the step of recovering the chargeability of the image region as described above, a stable image region potential can be obtained in a short time, and the next printing step can proceed quickly.

In the invention, the image region potential is increased to a value from 0.7 to 1.3 times the practical potential by repeatedly charging the printing master with the uniform exposure lamp or the discharging lamp maintained turned off (or with the light eliminated). The practical potentiaL ($V_A$) is −400 V. The potential to be given to the printing master should be determined from the fatigue effect of the photo-sensitive material, and it is preferable that the potential be in the range of 0.7 to 1.3 times the practical potential ($V_A$).

The invention will be described in detail with reference to the following example.

EXAMPLE

A toner image was formed on a photo-sensitive sheet according to the electrostatic method and was subjected to a flash fixing operation at 3J/cm$^2$ to provide a printing master. The image region potential of the printing master was −150 V. When the printing master (the width of the photo-sensitive sheet being 257 mm) was charged twice by causing the drum to make to revolutions under the conditions that the process speed was 400 mm/sec, the voltage applied by the charging unit was −7 KV, the current flowing in the photo-sensitive sheet was about −200 μA and that the discharging lamp was maintained off, the image region potential of the printing master was increased to about −380 V. In the third charging of the printing master with the discharging lamp now turned on, the image region potential reached −420 V, and in the fourth charging of the printing master, the image region potential reached −400 V. Thus, a stable image region potential was obtained.

When the printing master was charged under the same conditions as those described above except that the discharging lamp was maintained turned on, the image region potential reached −400 V in the twentieth charging operation.

What is claimed is:

1. An electrostatic printing method, comprising; forming a printing master having a fixed toner image on a photo-conductive plate;

repeatedly charging said printing master with a light source maintained off until a potential from 0.7 to 1.3 times a practical potential is given thereto, and then charging said printing master with said light source turned on, to thereby recover an image region potential of said printing master; and printing using said printing master.

2. A method as claimed in claim 1, said practical value comprising a saturation value of said printing master when charging with said light maintained on.

3. A method as claimed in claim 1, said light source comprising a discharging lamp.

4. A method as claimed in claim 1, said light source comprising a uniform exposure lamp.

5. A method as claimed in claim 1, said toner image on said printing master being fixed by application of infrared radiation.

6. A method as claimed in claim 1, said toner image on said printing master being fixed by application of flash fixing.

7. A method as claimed in claim 1, said printing master being charged by repeatedly rotating said master past a stationary charging unit.

8. A method as claimed in claim 1, said printing master being charged to from −280 to −520 volts prior to turning on said light source.

* * * * *